US010662037B2

(12) United States Patent
Cui

(10) Patent No.: US 10,662,037 B2
(45) Date of Patent: May 26, 2020

(54) ELECTRIC WINCH

(71) Applicant: Ningbo Lianda Winch Co., Ltd., Ningbo (CN)

(72) Inventor: Xiaojun Cui, Ningbo (CN)

( * ) Notice: Subject to any disclaimer, the term of this patent is extended or adjusted under 35 U.S.C. 154(b) by 123 days.

(21) Appl. No.: 16/112,734

(22) Filed: Aug. 26, 2018

(65) Prior Publication Data

US 2019/0382247 A1 Dec. 19, 2019

(30) Foreign Application Priority Data

Jun. 19, 2018 (CN) ..... 2018 1 0629006

(51) Int. Cl.
*B66D 1/12* (2006.01)

(52) U.S. Cl.
CPC ..... *B66D 1/12* (2013.01)

(58) Field of Classification Search
CPC ... B66D 1/12; B66D 1/22; B66D 1/28; B66D 1/40
See application file for complete search history.

(56) References Cited

U.S. PATENT DOCUMENTS

| | | | | |
|---|---|---|---|---|
| 4,635,903 | A * | 1/1987 | Broyden | B66D 3/26 174/DIG. 12 |
| 10,112,808 | B2 * | 10/2018 | Fretz | B66D 1/12 |
| 10,322,916 | B2 * | 6/2019 | Cui | B66D 1/00 |
| 2007/0221898 | A1 * | 9/2007 | Giacomini | B66D 1/08 254/323 |
| 2008/0001132 | A1 * | 1/2008 | Huang | B66D 1/12 254/362 |
| 2014/0001427 | A1 * | 1/2014 | Fretz | B66D 1/12 254/342 |
| 2016/0167935 | A1 * | 6/2016 | Fretz | B66D 1/22 254/344 |
| 2018/0118529 | A1 * | 5/2018 | Vaughn | B66D 1/12 |
| 2018/0175713 | A1 * | 6/2018 | Fretz | H02K 7/116 |

* cited by examiner

*Primary Examiner* — Michael E Gallion
(74) *Attorney, Agent, or Firm* — W&K IP

(57) ABSTRACT

The present disclosure discloses an electric winch which comprises a motor having a motor housing, a first terminal, a second terminal and a third terminal, and an insulating cover plate having a mounting hole, a first inner bore column and a second inner bore column. A first through hole, a second through hole and a third through hole are provided on an outer edge of the motor housing. The embodiment allows pre-mounting of the terminals on the insulating cover plate before they are fixed to the motor housing and provides higher efficiency in the assembly process.

10 Claims, 6 Drawing Sheets

ELECTRIC WINCH

CROSS-REFERENCE TO RELATED APPLICATIONS

This application claims priority to Chinese Patent Application No. 201810629006.3 with a filing date of Jun. 19, 2018. The content of the aforementioned applications, including any intervening amendments thereto, are incorporated herein by reference.

TECHNICAL FIELD

The present disclosure relates to the field of winches, and more particularly to the structure of an electric winch for vehicles.

BACKGROUND OF THE PRESENT INVENTION

Winches are devices used to rescue vehicles, drag obstacles or install equipments in harsh environments. Many off-road vehicles, agricultural vehicles, yachts, fire rescue vehicles, road wreckers and other special-purpose vehicles are equipped with winches.

A winch in the prior arts is generally provided with an electric motor. The motor includes a motor housing, and three terminal posts are generally fixed on the motor housing for transferring power to the internal components of the motor. The three terminal posts are fixed separately to the motor housing. During assembly, the three terminal posts are separately mounted on the motor housing by manually placing the terminal posts inside the motor housing and screwing the terminal posts to respective nuts. In addition, the brush component in the winch motor is generally fixed on a support bracket of a winding drum in order to facilitate installation of the brush component. As a result, the components inside the motor would be divided into different portions. Before fixing the motor housing to the support bracket, the rotor component and the brush component must be assembled together. The above assembly is a cumbersome process and suffers from a low efficiency.

SUMMARY OF PRESENT INVENTION

One objective of the present disclosure is to solve some problem of the prior arts and provide a winch which enables higher efficiency in assembly.

An electric winch according to an embodiment comprises a motor having a motor housing, a first terminal, a second terminal and a third terminal, and an insulating cover plate having a mounting hole, a first inner bore column and a second inner bore column. A first through hole, a second through hole and a third through hole are provided on an outer edge of the motor housing. The insulating cover plate is fixed on the outer edge of the motor housing to cover the first through hole, the second through hole and the third through hole. The first inner bore column passes through the first through hole. The second inner bore column passes through the second through hole. The first terminal is fixedly connected with the first inner bore column. The second terminal is fixedly connected with the second inner bore column. The third terminal is fixedly connected with the mounting hole. The first terminal, the second terminal and the third terminal are not in direct contact with the motor housing.

In an embodiment, a limiting boss is provided inside the motor housing on an inner end of third terminal facing the motor housing. An outer end of the third terminal facing the motor housing comprises a threaded section. The third terminal is screwed to a third nut by passing through the third through hole and the mounting hole. An insulating spacer is arranged between the motor housing and the limiting boss. The limiting boss, the insulating spacer and the third nut are used to fix the motor housing to the insulating cover plate.

In an embodiment, the first terminal passes through the first inner bore column to screw to a first nut. The second terminal passes through the second inner bore column to screw to a second nut. The first nut and the second nut are both located outside the insulating cover plate. A first sealing gasket is arranged between the first nut and the insulating cover plate. A second sealing gasket is arranged between the second nut and the insulating cover plate. A third sealing gasket is arranged between the third nut and the insulating cover plate.

In an embodiment, the insulating cover plate comprises a third inner bore column. The mounting hole passes through the third inner bore column, and the third terminal is fixedly connected to the third inner bore column.

In an embodiment, the first terminal passes through the first inner bore column to screw to a first nut. The second terminal passes through the second inner bore column to screw to a second nut. The third terminal passes through the third inner bore column to screw to a t nut. The first nut, the second nut and the third nut are located outside the insulating cover plate. A first sealing gasket is arranged between the first nut and the insulating cover plate. A second sealing gasket is arranged between the second nut and the insulating cover plate. A third sealing gasket is arranged between the third nut and the insulating cover plate.

In an embodiment, the first through hole, the second through hole and the third through hole are radically arranged along the outer edge of the motor housing to form a triangular shape, and an axis of the third through hole passes through the center of the motor housing.

In an embodiment, a sealing component is arranged between the insulating cover plate and the motor housing.

In an embodiment, the motor comprises a coil component, a rotor component, a brush component and a brush holder for fixing the brush component. The coil component is fixedly connected to the motor housing. The coil component is arranged inside the motor housing. The rotor component is rotatably connected within the motor housing.

In an embodiment, the brush holder includes a mounting plate and a plurality of connecting plates provided on the mounting plate. The plurality of the connecting plates are circumferentially arranged along the mounting plate. A plurality of mounting vias are arranged on the motor housing corresponding to the positions of the connecting plates. The connecting plates are fixed to the motor housing by the mounting vias. A portion of each connecting plate extends in an axial direction of the motor housing. The mounting plate is perpendicular to the axis of the motor housing.

In an embodiment, the first terminal, the second terminal, the third terminal, and the brush component are positioned near the same end of the motor housing.

DESCRIPTION OF THE DRAWINGS

The present invention is illustrated by way of example and not limitation in the figures of the accompanying drawings, in which like references indicate similar elements, and in which.

REFERENCE NUMBERS

Figure 1:
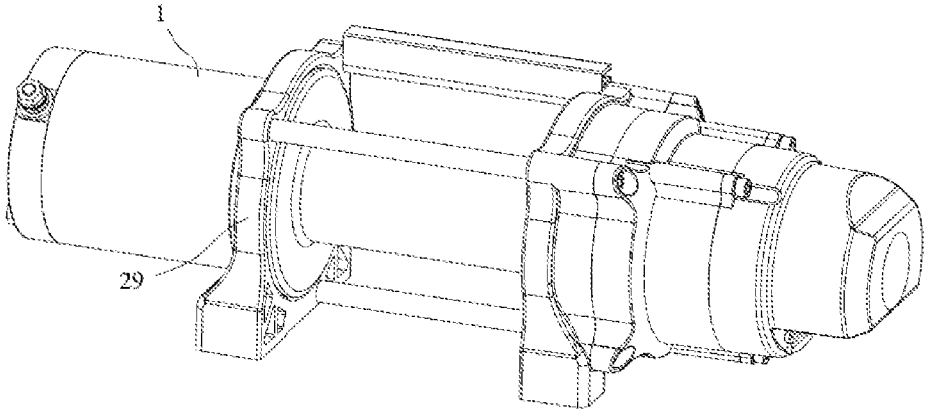
FIG. 1 is a schematic structural view of a first embodiment of the present disclosure.
Figure 2:
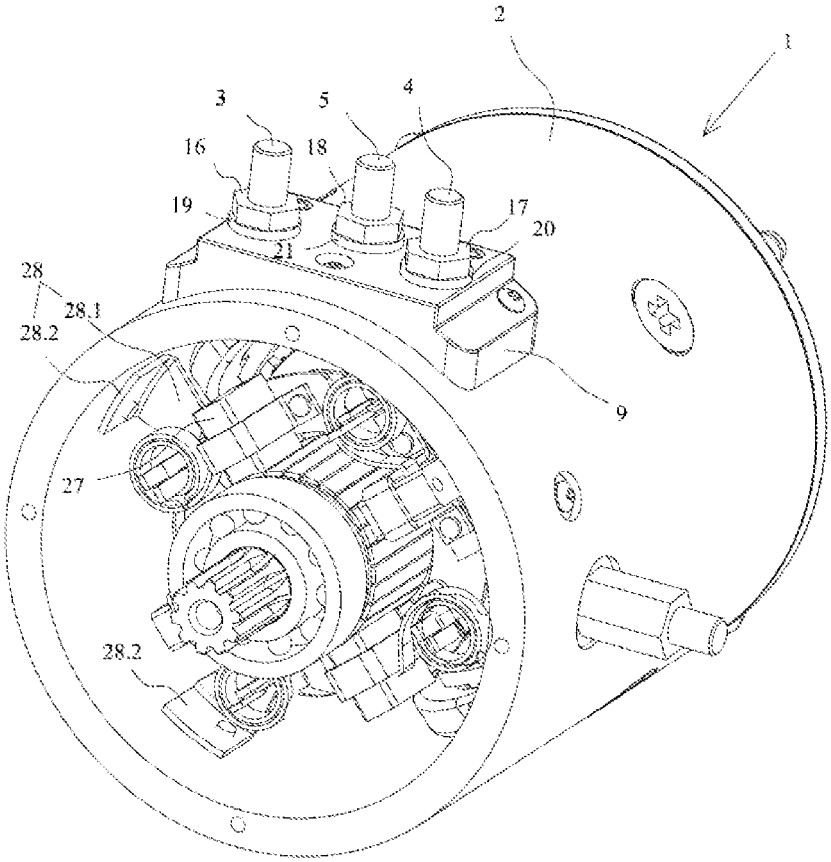
FIG. 2 is a schematic structural view of a motor of a first embodiment of the present disclosure.
Figure 3:
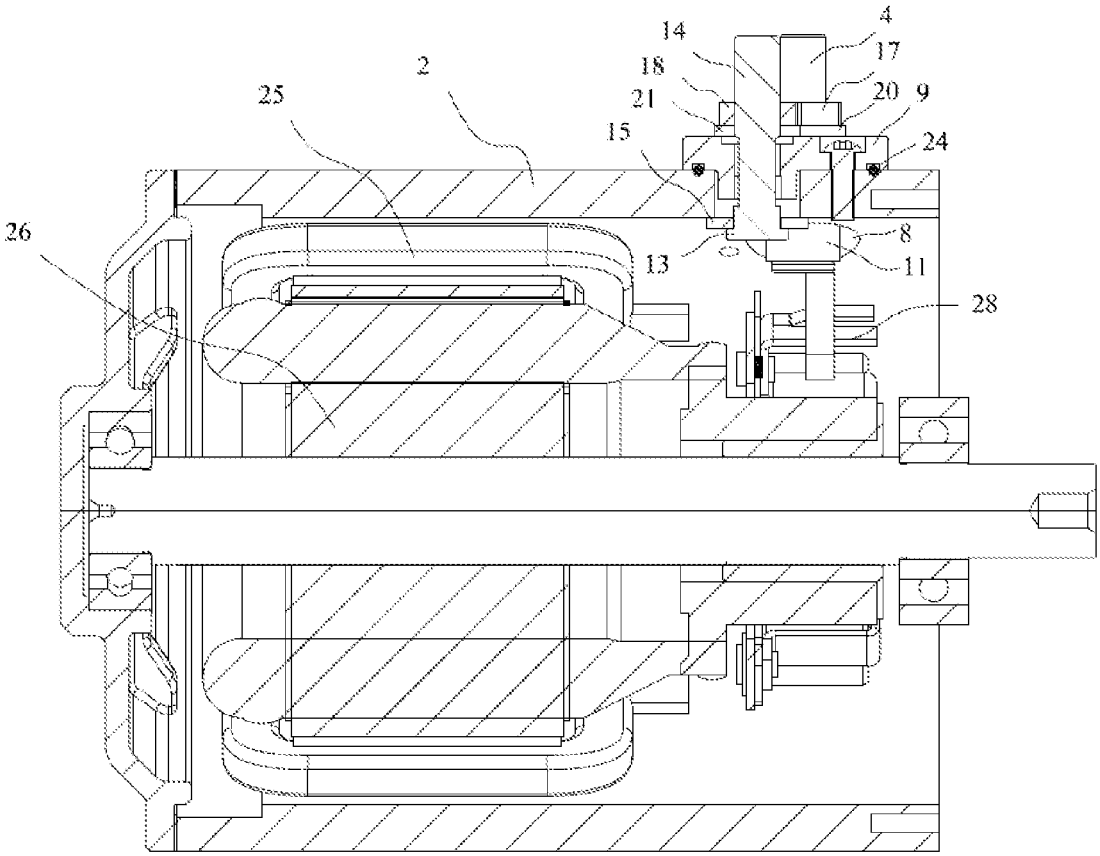
FIG. 3 is a schematic sectional view of a motor of a first embodiment of the present disclosure.
Figure 4:
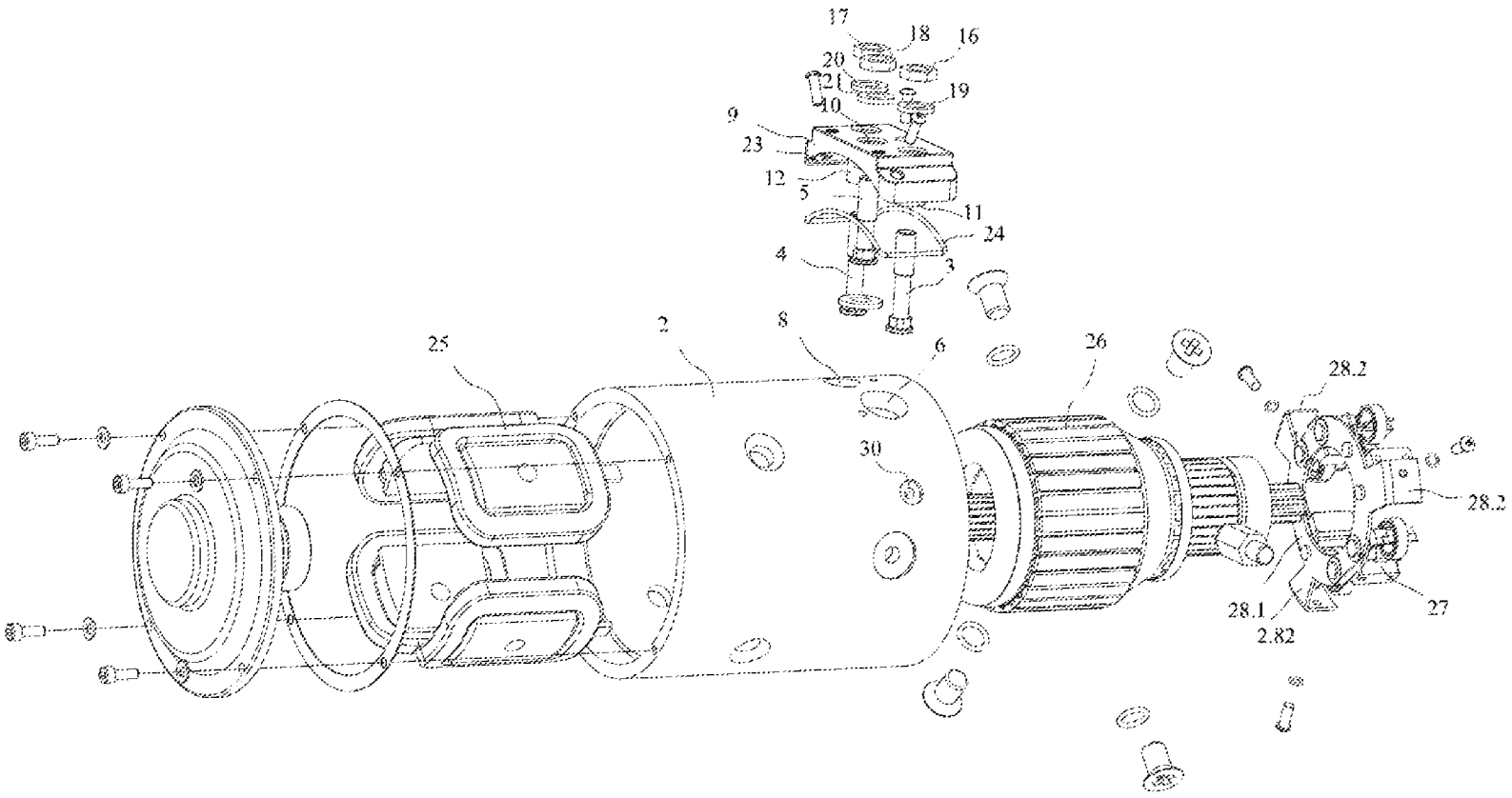
FIG. 4 is a schematic explosive view of a motor of a first embodiment of the present disclosure.
Figure 5:
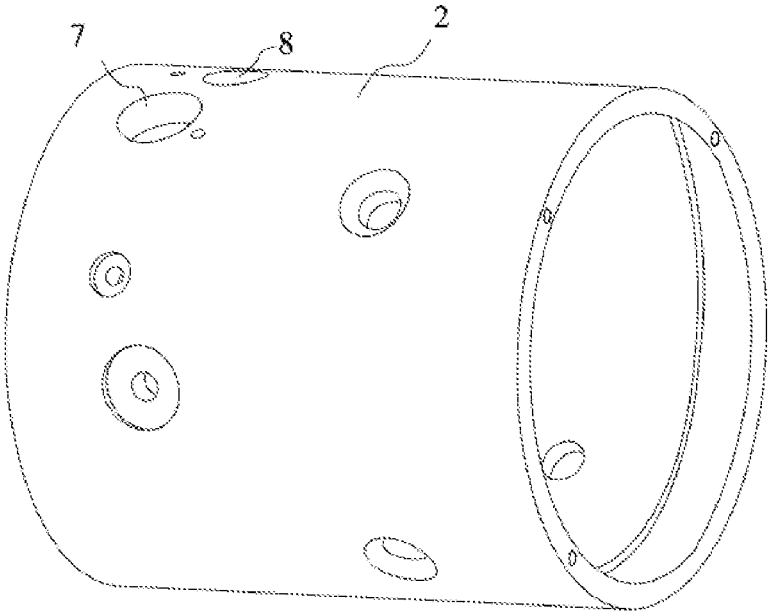
FIG. 5 is a schematic view of a motor housing of a first embodiment of the present disclosure.

1 motor, 2 motor housing, 3 first terminal, 4 second terminal, 5 third terminal, 6 first through hole, 7 second through hole, 8 third through hole, 9 insulating cover plate, 10 mounting hole, 11 first inner bore column, 12 second inner bore column, 13 limiting boss, 14 threaded section, 15 insulating spacer, 16 first nut, 17 second nut, 18 third nut, 19 first sealing gasket, 20 second sealing gasket, 21 third sealing gasket, 22 third inner bore column, 23 annular groove, 24 sealing ring, 25 coil component, 26 rotor component, 27 brush component, 28 brush holder, 28.1 mounting plate, 28.2 connecting plates, 29 winding drum bracket, 30 mounting via.

DETAILED DESCRIPTION OF PREFERRED EMBODIMENTS

Exemplary embodiments are provided such that the disclosure will be thorough, and will fully convey the scope to those who skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The skilled in the art will be understand that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items. The terms "connected", "coupled" may mean any electric or mechanical connection, either direct or indirect, between two or more elements.

As shown in FIG. 1-5, an electric winch of a first embodiment comprises a motor 1 having a motor housing 2, a first terminal 3, a second terminal 4 and a third terminal 5. A first through hole 6, a second through hole 7 and a third through hole 8 are provided on an outer edge of the motor housing 2. The motor 1 also comprises an insulating cover plate 9 having a mounting hole 10, a first inner bore column 11 and a second inner bore column 12. The insulating cover plate 9 is fixed on the outer edge of the motor housing 2 to cover the first through hole 6, the second through hole 7 and the third through hole 8. The first inner bore column 11 passes through the first through hole 6. The second inner bore column 12 passes through the second through hole 7. The first terminal 3 is fixedly connected with the first inner bore column 11. The second terminal 4 is fixedly connected with the second inner bore column 12. The third terminal 5 is fixedly connected with the mounting hole 10. None of the first terminal 3, the second terminal 4 and the third terminal 5 is in direct contact with the motor housing 2. The third through hole 8 corresponds to the position of the mounting hole 10.

During assembly, the first terminal 3 and the second terminal 4 can be fixed connected to the first inner bore column 11 and the second inner bore column 12 through the insulating cover plate 9 outside the motor housing 2 respectively, before connecting the insulating cover plate 9 to the motor housing 2. The assembly of the first terminal 3 and the second terminal 4 according to the embodiments is more efficient compared to prior arts in that both terminals can be simultaneously mounted to the motor housing 2 from outside.

None of the first terminal 3, the second terminal 4 and the third terminal 5 should be in direct contact with the motor housing 2 or the motor housing 2 may be conducting electricity when the first terminal 3, the second terminal 4 and the third terminal 5 are connected to a power supply. The insulating cover plate 9 can be screwed to the motor housing 2.

A limiting boss 13 is provided inside the motor housing 2 on an inner end of third terminal 5 facing the motor housing 2. An outer end of the third terminal 5 facing the motor housing 2 comprises a threaded section 14. The third terminal 5 is screwed to a third nut 18 by passing through the third through hole 8 and the mounting hole 10. An insulating spacer 15 is arranged between the motor housing 2 and the limiting boss 13. The limiting boss 13, the insulating spacer 15 and the third nut 18 are used to fix the motor housing 2 to the insulating cover plate 9.

The fixing mechanism of the third terminal 5 of the embodiment is also used to fix the insulating cover plate 9 to the motor housing 2, so that the insulating cover plate 9 is less likely to loosen after operating for a long time or after a long travel by vehicle. The insulating spacer 15 is arranged to avoid contact between the third terminal 5 and the motor housing 2 and to prevent the motor housing 2 from being charged. The first terminal 3, the second terminal 4, and the third terminal 5 may be identical in structure.

The first terminal 3 passes through the first inner bore column 11 to screw to a first nut 16. The second terminal 4 passes through the second inner bore column 12 to screw to a second nut 17. The first nut 16 and the second nut 17 are both located outside the insulating cover plate 9. A first sealing gasket 19 is arranged between the first nut 16 and the insulating cover plate 9. A second sealing gasket 20 is arranged between the second nut 17 and the insulating cover plate 9. A third sealing gasket 21 is arranged between the third nut 18 and the insulating cover plate 9. The configuration provides leakproofness at the positions of the first terminal 3, the second terminal 4 and the third terminal 5 and avoids entering of water into the interior space of the motor.

The first through hole 6, the second through hole 7, and the third through hole 8 are radically arranged along the outer edge of the motor housing 2 to form a triangular shape. An axis of the third through hole 8 passes through the center of the motor housing 2. The size of the insulating cover plate 9 can be reduced as a result.

A sealing component is arranged between the insulating cover plate 9 and the motor housing 2. The sealing component is used to provide leakproofness between the insulating cover plate 9 and the motor housing 2 and prevent water leakage into the motor. The sealing component comprises an annular groove 23 arranged on an end face of the insulating cover plate 9 and a sealing ring 24 inside the annular groove 23. The annular groove 23 can be arranged on the motor housing 2.

The motor 1 comprises a coil component 25, a rotor component 26, a brush component 27 and a brush holder 28 for fixing the brush component 27. The coil component 25 is fixedly connected to the motor housing 2. The coil component 25 is arranged inside the motor housing 2. The rotor component 26 is rotatably connected within the motor housing 2. The internal components of the motor are mounted inside the motor housing 2, and the motor housing 2 can be then fixed to a winding drum bracket 29 to close the open end. In one example, the coil component 25 is screwed to the motor housing 2.

The brush holder 28 includes a mounting plate 28.1 and a plurality of connecting plates 28.2 provided on the mounting plate 28.1. The plurality of the connecting plates 28.2 are circumferentially arranged along the mounting plate 28.1. A plurality of mounting vias 30 are arranged on the motor housing 2 corresponding to the positions of the connecting plates 28.2. The connecting plates 28.2 are fixed to the motor housing 2 by the mounting vias 30. A portion of each connecting plate 28.2 extends in an axial direction of the motor housing 2. The mounting plate 28.1 is perpendicular to the axis of the motor housing 2. The connecting plates 28.2 can be adapted to the internal structures of the motor housing 2. The mounting plate 28.1 can be used to fix the brush component 27 inside the motor housing 2.

The first terminal 3, the second terminal 4, the third terminal 5, and the brush component 27 are positioned near the same end of the motor housing 2, which can be the end near to the winding drum bracket 29 or the end far from the winding drum bracket 29. This configuration facilitates electrically coupling the first terminal 3, the second terminal 4, and the third terminal 5.

The first terminal 3, the second terminal 4, and the third terminal 5 can be positioned above the brush component 27 to reduce the distance between the brush component 27 and the terminals 3, 4 and 5. The motor housing 2 can be of cylindrical shape.

Figure 6:
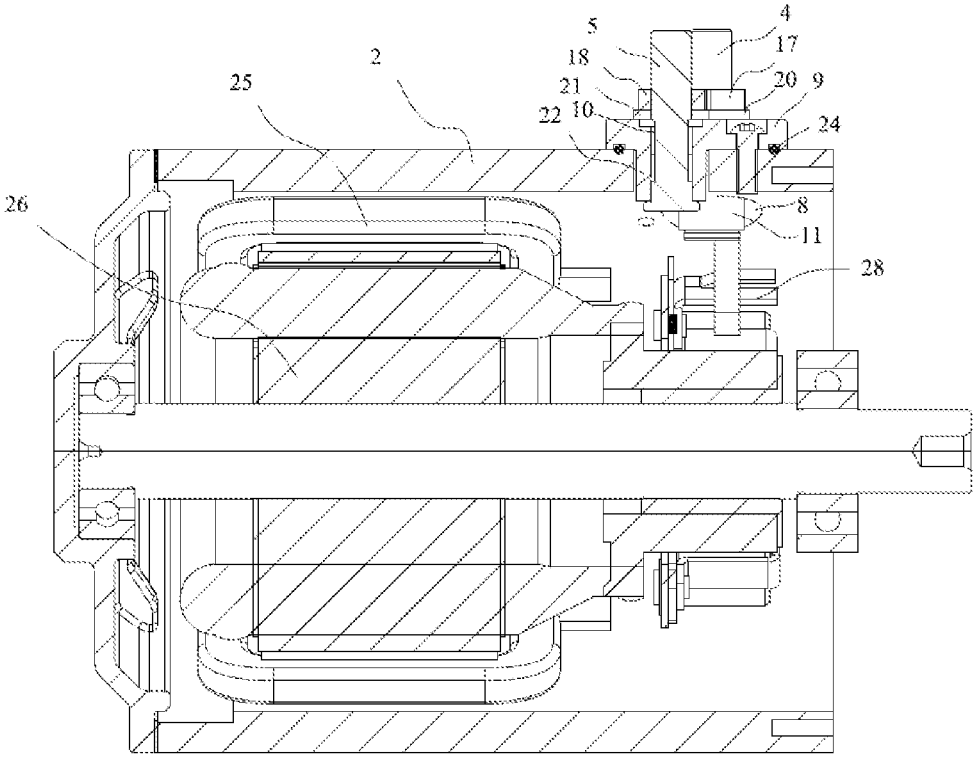
FIG. 6 is a schematic sectional view of a motor of a second embodiment of the present disclosure.

In a second embodiment as shown in FIG. 6, the connection of the third terminal 5 to the mounting hole 10 may be implemented in a different approach. Taking reference to FIG. 1-6, the insulating cover plate 9 comprises a third inner bore column 22. The mounting hole 10 passes through the third inner bore column 22. The third terminal 5 is fixedly connected to the third inner bore column 22. The third terminal 5 can be pre-mounted on the insulating cover plate 9 along with the first terminal 3 and the second terminal 4 before fixing the insulating cover plate 9 to the motor housing 2. Production efficiency can be improved since the first terminal 3, the second terminal 4, and the third terminal 5 can be installed at one time.

In the second embodiment, the first terminal 3 passes through the first inner bore column 11 to screw to the first nut 16. The second terminal 4 passes through the second inner bore column 12 to screw to a second nut 17. The third terminal 5 passes through the third inner bore column 22 to screw to a third nut 18. The first nut 16, the second nut 17, and the third nut 18 are located outside the insulating cover plate 9. A first sealing gasket 19 is arranged between the first nut 16 and the insulating cover plate 9. A second sealing gasket 20 is arranged between the second nut 17 and the insulating cover plate 9. A third sealing gasket 21 is arranged between the third nut 18 and the insulating cover plate 9. The configuration provides leakproofness at the positions of the first terminal 3, the second terminal 4 and the third terminal 5 and avoids entering of water into the interior space of the motor.

The foregoing description of the embodiments has been provided for purposes of illustration and description. It is not intended to be exhaustive or to limit the disclosure. Variations or modifications of the embodiments are not to be regarded as a departure from the disclosure, and all such modifications are intended to be included within the scope of the disclosure.

I claim:

1. An electric winch, comprising:

a motor having a motor housing, a first terminal, a second terminal and a third terminal; and an insulating cover plate having a mounting hole, a first inner bore column and a second inner bore column, wherein a first through hole, a second through hole and a third through hole are provided on an outer edge of the motor housing;

the insulating cover plate is fixed on the outer edge of the motor housing to cover the first through hole, the second through hole and the third through hole;

the first inner bore column passes through the first through hole;

the second inner bore column passes through the second through hole;

the first terminal is fixedly connected with the first inner bore column;

the second terminal is fixedly connected with the second inner bore column;

the third terminal is fixedly connected with the mounting hole; and the first terminal, the second terminal and the third terminal are not in direct contact with the motor housing.

2. The electric winch of claim 1, wherein a limiting boss is provided inside the motor housing on an inner end of third terminal facing the motor housing;

an outer end of the third terminal facing the motor housing comprises a threaded section;

the third terminal is screwed to a third nut by passing through the third through hole and the mounting hole;

an insulating spacer is arranged between the motor housing and the limiting boss; and the limiting boss, the insulating spacer and the third nut are used to fix the motor housing to the insulating cover plate.

3. The electric winch of claim 2, wherein the first terminal passes through the first inner bore column to screw to a first nut;

the second terminal passes through the second inner bore column to screw to a second nut;

the first nut and the second nut are both located outside the insulating cover plate;

a first sealing gasket is arranged between the first nut and the insulating cover plate;

a second sealing gasket is arranged between the second nut and the insulating cover plate; and a third sealing gasket is arranged between the third nut and the insulating cover plate.

4. The electric winch of claim 1, wherein the insulating cover plate comprises a third inner bore column, the mounting hole passes through the third inner bore column, and the third terminal is fixedly connected to the third inner bore column.

5. The electric winch of claim 4, wherein the first terminal passes through the first inner bore column to screw to a first nut;

the second terminal passes through the second inner bore column to screw to a second nut;

the third terminal passes through the third inner bore column to screw to a third nut;

the first nut, the second nut and the third nut are located outside the insulating cover plate;

a first sealing gasket is arranged between the first nut and the insulating cover plate;

a second sealing gasket is arranged between the second nut and the insulating cover plate; and a third sealing gasket is arranged between the third nut and the insulating cover plate.

6. The electric winch of claim 1, wherein the first through hole, the second through hole and the third through hole are radically arranged along the outer edge of the motor housing to form a triangular shape, and an axis of the third through hole passes through the center of the motor housing.

7. The electric winch of claim 1, wherein a sealing component is arranged between the insulating cover plate and the motor housing.

8. The electric winch of claim 1, wherein the motor comprises a coil component, a rotor component, a brush component and a brush holder for fixing the brush component;

the coil component is fixedly connected to the motor housing;

the coil component is arranged inside the motor housing; and the rotor component is rotatably connected within the motor housing.

9. The electric winch of claim 8, wherein the brush holder includes a mounting plate and a plurality of connecting plates provided on the mounting plate;

the plurality of the connecting plates are circumferentially arranged along the mounting plate;

a plurality of mounting vias are arranged on the motor housing corresponding to the positions of the connecting plates;

the connecting plates are fixed to the motor housing by the mounting vias;

a portion of each connecting plate extends in an axial direction of the motor housing; and the mounting plate is perpendicular to the axis of the motor housing.

10. The electric winch of claim 8, wherein the first terminal, the second terminal, the third terminal, and the brush component are positioned near the same end of the motor housing.

* * * * *